US010885832B1

(12) United States Patent
Watsuda et al.

(10) Patent No.: US 10,885,832 B1
(45) Date of Patent: Jan. 5, 2021

(54) DISPLAY DEVICE

(71) Applicant: InnoLux Corporation, Miao-Li County (TW)

(72) Inventors: Hirofumi Watsuda, Miao-Li County (TW); Tsau-Hua Hsieh, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 16/505,647

(22) Filed: Jul. 8, 2019

(51) Int. Cl.
*G09G 3/32* (2016.01)

(52) U.S. Cl.
CPC ..... *G09G 3/32* (2013.01); *G09G 2310/027* (2013.01); *G09G 2320/0633* (2013.01)

(58) Field of Classification Search
CPC ..... G09G 3/32; G09G 2320/0633; G09G 2310/027
See application file for complete search history.

(56) References Cited

U.S. PATENT DOCUMENTS

2014/0028732 A1* 1/2014 Kim ..... G09G 3/3266 345/690
2014/0306868 A1* 10/2014 Chaji ..... G09G 3/32 345/77
2015/0194106 A1* 7/2015 Cho ..... G09G 3/3607 345/691
2017/0062515 A1 3/2017 Kim
2017/0301283 A1* 10/2017 Liu ..... G09G 3/3233
2018/0053460 A1* 2/2018 Watsuda ..... G09G 3/2074
2018/0158847 A1* 6/2018 Chang ..... H01L 27/1259
2018/0197934 A1* 7/2018 Chen ..... H01L 27/3265
2018/0198020 A1* 7/2018 Lai ..... H01L 27/1225
2018/0322827 A1* 11/2018 Zhang ..... G09G 3/2011
2019/0171403 A1* 6/2019 Hall ..... H05K 13/00
2019/0206330 A1* 7/2019 Kim ..... G09G 3/3233
2019/0392769 A1* 12/2019 Lee ..... G09G 3/3225
2020/0005700 A1* 1/2020 Behringer ..... G09G 3/32

* cited by examiner

*Primary Examiner* — Vinh T Lam
(74) *Attorney, Agent, or Firm* — Winston Hsu

(57) ABSTRACT

A method for expressing a grey level of a sub-pixel in a display device includes providing at least one light emitting unit in the sub-pixel, the light emitting unit including a plurality of illumination portions, and illuminating at least one of the plurality of illumination portions to express the grey level of the sub-pixel, and each illumination portion is illuminated independently.

11 Claims, 9 Drawing Sheets

DISPLAY DEVICE

BACKGROUND OF THE DISCLOSURE

1. Field of the Disclosure

The present disclosure is related to a display device, and more particularly to a display device including a plurality of illumination portions.

2. Description of the Prior Art

Presently, passive matrix (PM) and active matrix (AM) driving methods have been adopted as two primary methods for driving light-emitting components. Despite the complicated process for fabricating an active matrix, each pixel in the active matrix can be driven continuously and independently, and driving signal of each pixel can be recorded without using a high pulse current for a long time to drive each pixel. Therefore, the active matrix is able to provide higher efficiency and extending a service life of a light-emitting component in comparison to the passive matrix driving method.

In the prior art, the active matrix driving method mainly drives the light emitting components through currents of different sizes, so that the light emitting component can emit light of different brightness. For example, the display panel can continuously drive the light emitting component with a corresponding current in a present frame, and drive the light emitting component with the updated current in the next frame period. Therefore, the light emitting component can present the brightness required for each frame. In this case, if it is desired to increase the number of luminance grey levels presented by the light-emitting components, it would be necessary to drive the light-emitting components with a small current to present the grey level of low brightness. However, when the light-emitting component is driven by a small current, the light emitted from the light-emitting component easily undergoes a significant color shift, resulting in poor picture quality.

SUMMARY OF THE DISCLOSURE

One embodiment of the present disclosure discloses a method for expressing a grey level of a sub-pixel in a display device.

The method includes providing at least one light emitting unit in the sub-pixel, and the light emitting unit includes a plurality of illumination portions. Each illumination portion is illuminated independently. The method further includes illuminating at least one of the plurality of illumination portions to express the grey level of the sub-pixel according to a data signal.

Another embodiment of the present disclosure discloses a display device. The display device includes a plurality of sub-pixels.

One of the plurality of sub-pixels includes at least one light emitting unit and a plurality of driving units. The at least one light emitting unit includes a plurality of illumination portions. Each of the driving units is coupled to a corresponding illumination portion of the plurality of illumination portions, and drives the corresponding illumination portion to express a plurality of grey levels in different frames.

These and other objectives of the present disclosure will no doubt become obvious to those of ordinary skill in the art after reading the following detailed description of the embodiment that is illustrated in the various figures and drawings.

DETAILED DESCRIPTION

Figure 1:
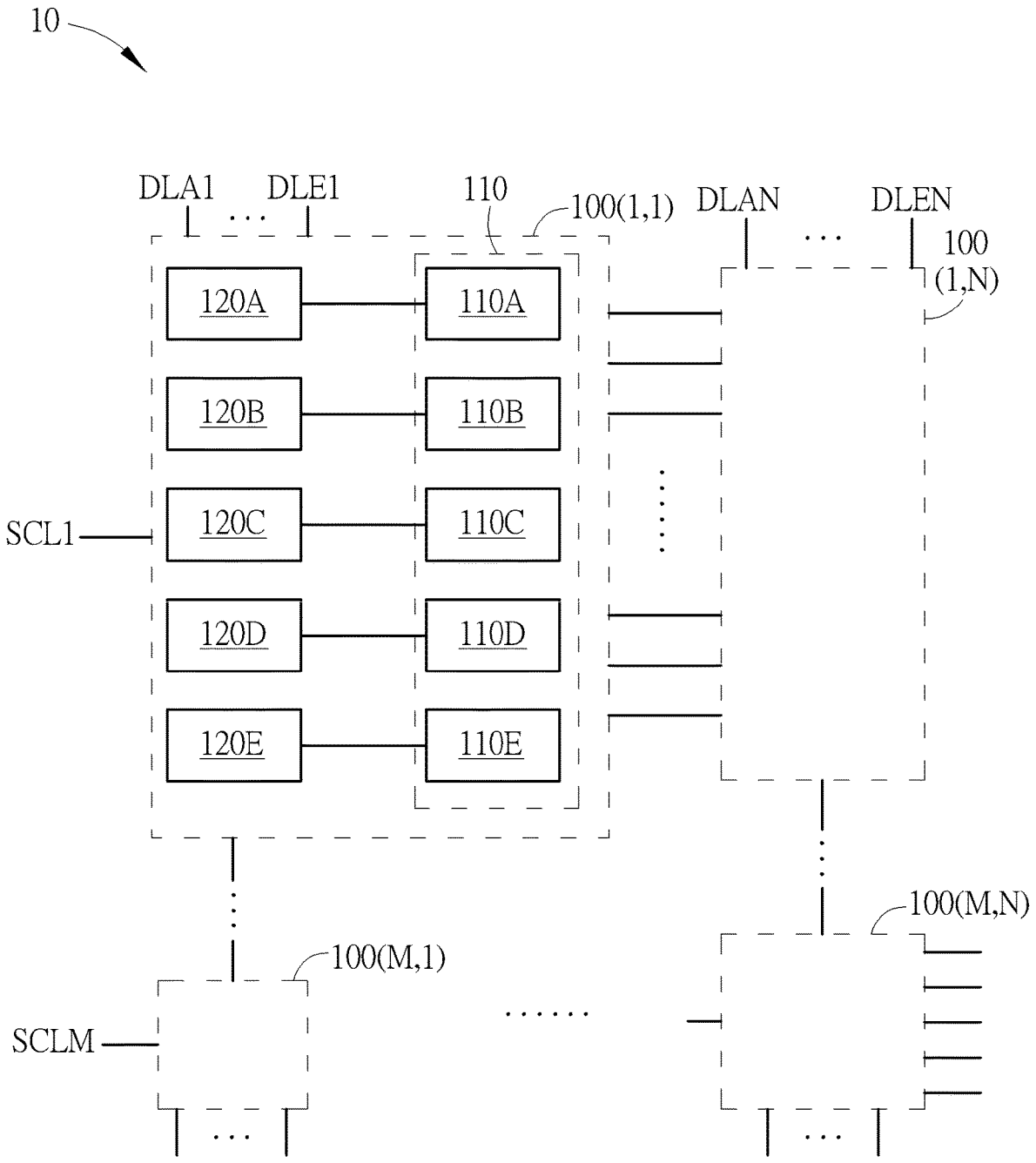
FIG. 1 shows a display device according to one embodiment of the present disclosure.

FIG. 1 shows a display device 10 according to one embodiment of the present disclosure. The display device 10 includes a plurality of sub-pixels 100(1,1) to 100(M,N), where M and N are positive integers. Each of the sub-pixels 100 can emit light at a plurality of grey levels in different frames.

In FIG. 1, sub-pixels disposed in the same row can be coupled to the same scan line, and sub-pixels disposed in the same column can be coupled to the same data lines. For example, sub-pixels 100(1,1) to 100(1,N) can be coupled to the scan line SCL1, and sub-pixels 100(M,1) to 100(M,N) can be coupled to the scan line SCLM. Also, sub-pixels 100(1,1) to 100(M,1) can be coupled to the data lines DLA1 to DLE1, and sub-pixels 100(1,N) to 100(M,N) can be coupled to the data lines DLAN to DLEN.

In some embodiments, the sub-pixels 100(1,1) to 100(M, N) have the same structure. For example, the sub-pixel 100(1,1) includes a light emitting unit 110, and a plurality of driving units 120A, 120B, 120C, 120D, and 120E. The light emitting unit 110 includes a plurality of illumination regions 110A, 110B, 110C, 110D, and 110E, and the illumination portions 110A, 110B, 110C, 110D, and 110E can have different sizes and/or different shape. In one embodiment, the shape of the illumination portion may be, for example but not limited to, a circle, a rectangular, a square, or a free shape. In some embodiments, each of the illumination portions 110A, 110B, 110C, 110D, and 110E may include a light emitting diode (LED), the LED could be an organic LED or inorganic LED (such as quantum-dot LED, Mini-LED, or Micro-LED), and the sizes of the LEDs in the illumination portions 110A, 110B, 110C, 110D, and 110E are different. That is, the maximal brightness of the illumination portions 110A, 110B, 110C, 110D, and 110E are different, and the sub-pixels 100(1,1) to 100(M,N) can present different grey levels with modulated illumination portions.

Also, each of the driving units 120A, 120B, 120C, 120D, and 120E is coupled to a corresponding illumination portion of the plurality of illumination portions 110A, 110B, 110C, 110D, and 110E, and can be used to drive the corresponding illumination portion to express a plurality of grey levels according to the data signal received in different frames. For example, the driving unit 120A can be coupled to the illumination portion 110A for driving the illumination portion 110A, and the driving unit 120E can be coupled to the illumination portion 110E for driving the illumination portion 110E.

That is, in FIG. 1, each of the sub-pixels 100 may have 5 illumination portions and each illumination portion can emit light at a plurality of grey levels. Consequently, by driving different illumination portions with different intensities, each of the sub-pixels 100 can emit light at a variety of grey levels without complicated control of the current.

For example, the area of the illumination portion 110B can be N times the area of the illumination portion 110A, the driving unit 120A can drive the illumination portion 110A to emit light at N grey levels, the driving unit 120B can drive the illumination portion 110B to emit light at N grey levels. In this case, the illumination portions 110A and 110B are able to present a total of $N^2$ grey levels, where N is an integer greater than 1.

Figure 2:
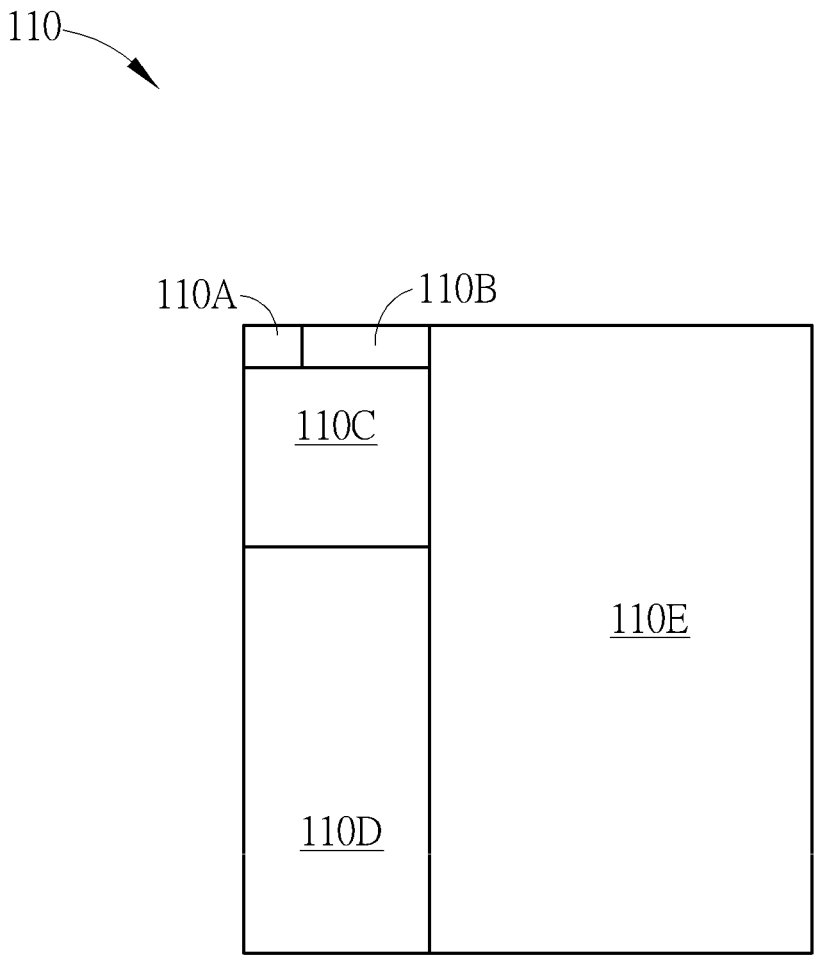
FIG. 2 shows the arrangement of the illumination portions in the light emitting unit according to one embodiment of the present disclosure.

FIG. 2 shows the arrangement of the illumination portions 110A, 110B, 110C, 110D, and 110E in the light emitting unit 110 according to one embodiment. In some embodiments, the size ratio of the illumination portions 110A, 110B, 110C, 110D, and 110E can be 1:4:16:64:256, and each of the illumination portions 110A, 110B, 110C, 110D, and 110E can present 4 different grey levels. If the 4 different grey levels are represented by 2 bits, then the grey level presented by the illumination portions 110A, 110B, 110C, 110D, and 110E can be determined by 10 bits. In this case, the illumination portion 110A would be controlled by the 2 least significant bits of the 10 bits, and the illumination portion 110E would be controlled by the 2 most significant bits of the 10 bits. Therefore, the sub-pixel 100 would be able to present $2^{10}$ (1024) grey levels in total.

Figure 3:
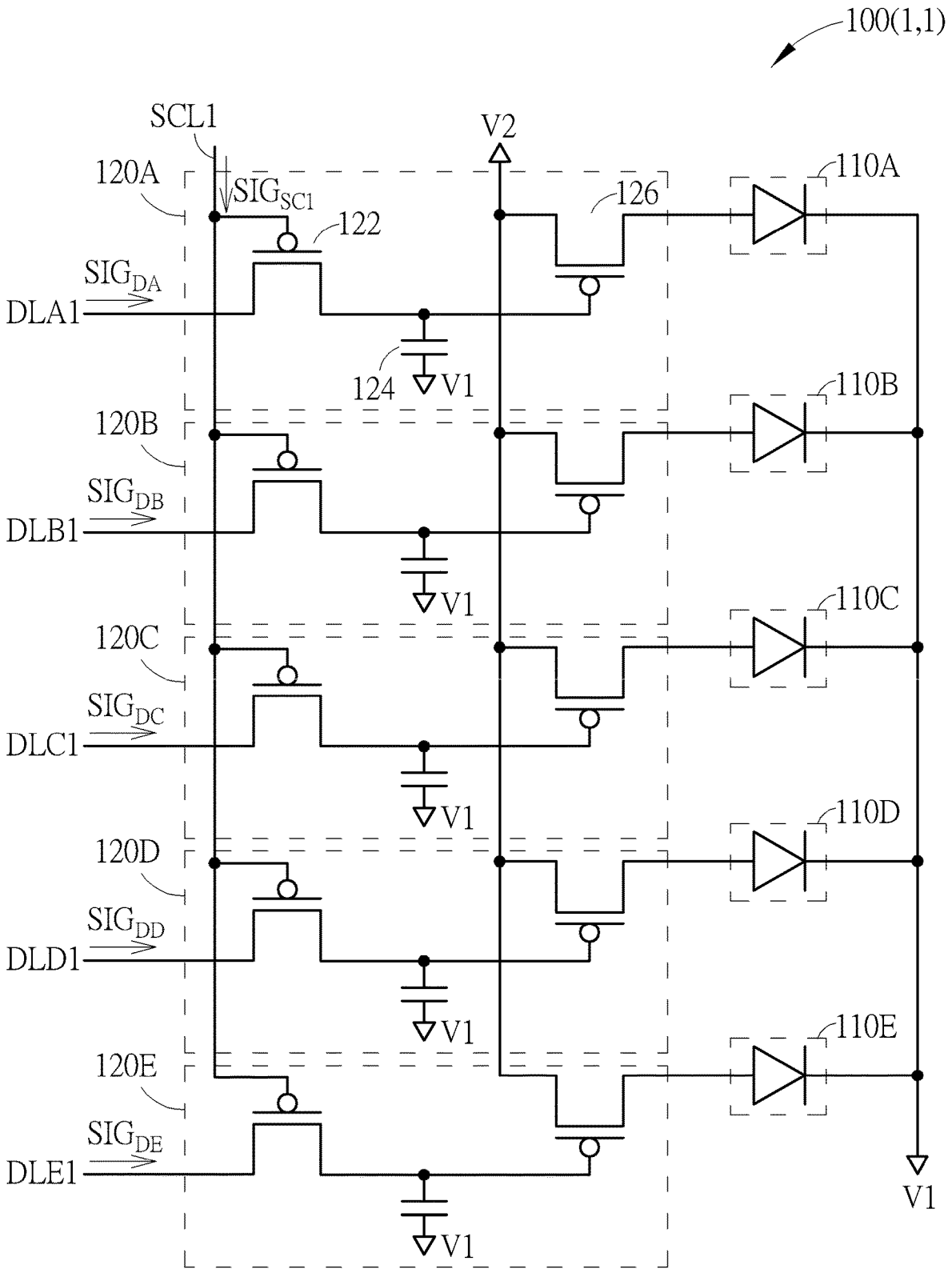
FIG. 3 shows the sub-pixel in FIG. 1 according to one embodiment of the present disclosure.

FIG. 3 shows the sub-pixel 100(1,1) according to one embodiment of the present disclosure. In FIG. 3, each of the driving units 120A, 120B, 120C, 120D, and 120E can drive the corresponding illumination portion 110A, 110B, 110C, 110D, and 110E to emit light at the plurality of grey levels by adjusting the amplitudes of the current according to the data signal.

The driving units 120A, 120B, 120C, 120D, and 120E can have the same structure. For example, the driving unit 120A includes a scan transistor 122, a capacitor 124, and a driving transistor 126. The scan transistor 122 has a first terminal coupled to a data line DLA, a second terminal, and a control terminal coupled to a scan line SCL1. The capacitor 124 has a first terminal coupled to the second terminal of the scan transistor 122, and a second terminal for receiving the voltage V1. The driving transistor 126 has a first terminal for receiving a voltage V2, a second terminal coupled to the LED of the illumination portion 110A, and a control terminal coupled to the second terminal of the scan transistor 122.

In this case, when the scan transistor 122 is turned on, the driving transistor 126 can adjust the current according to the data signal $SIG_{DA}$. That is, by adjusting the voltage of the data signal $SIG_{DA}$ transmitted on the data line DLA, the driving transistor 126 can generate the current with the desired intensity so as to drive the illumination portion 110A to emit light at the corresponding grey level. In some embodiments, the capacitor 124 can keep the voltage of the data signal $SIG_{DA}$ to stabilize the current generated by the driving transistor 126.

Figure 4:
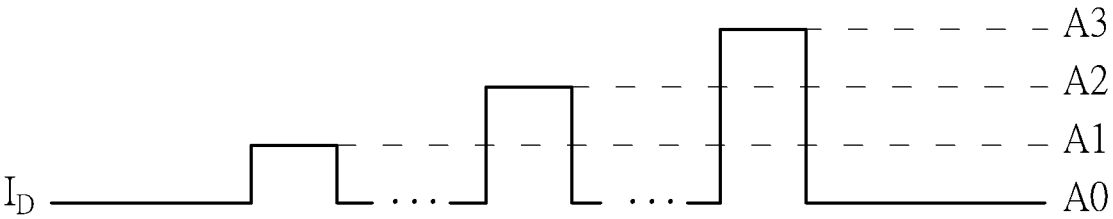
FIG. 4 shows the amplitude of the current when expressing four different grey levels according to one embodiment of the present disclosure.

FIG. 4 shows the amplitude of the current $I_D$ when expressing four different grey levels according to one embodiment. In some embodiments, to present four different grey levels, the data signal may be at four different voltages, and the driving transistor 126 would generate the current $I_D$ with amplitude of four different levels A0, A1, A2, and A3. In FIG. 4, the ratio of the four levels can be A0, A1, A2, and A3, for example but not limited to, 0:1:2:3, and the ratio of the brightness presented by the four grey levels would also be 0:1:2:3.

In FIG. 3, since the illumination portions 110A, 110B, 110C, 110D, and 110E are controlled and illuminated independently, the driving units 120A, 120B, 120C, 120D, and 120E can be coupled to different data lines DLA1, DLB1, DLC1, DLD1, and DLE1. Furthermore, in some embodiments, since the sizes of the illumination portions 110A, 110B, 110C, 110D, and 110E are different, the sizes of the driving transistors 126 of the driving units 120A, 120B, 120C, 120D, and 120E may also be different. For example, the driving transistor 126 in the driving unit 120B and the driving transistor 126 in the driving unit 120A can have the same channel length, but the channel width of the driving transistor 126 in the driving unit 120B can be four times the channel width of the driving transistor 126 in the driving unit 120A.

Figure 6:
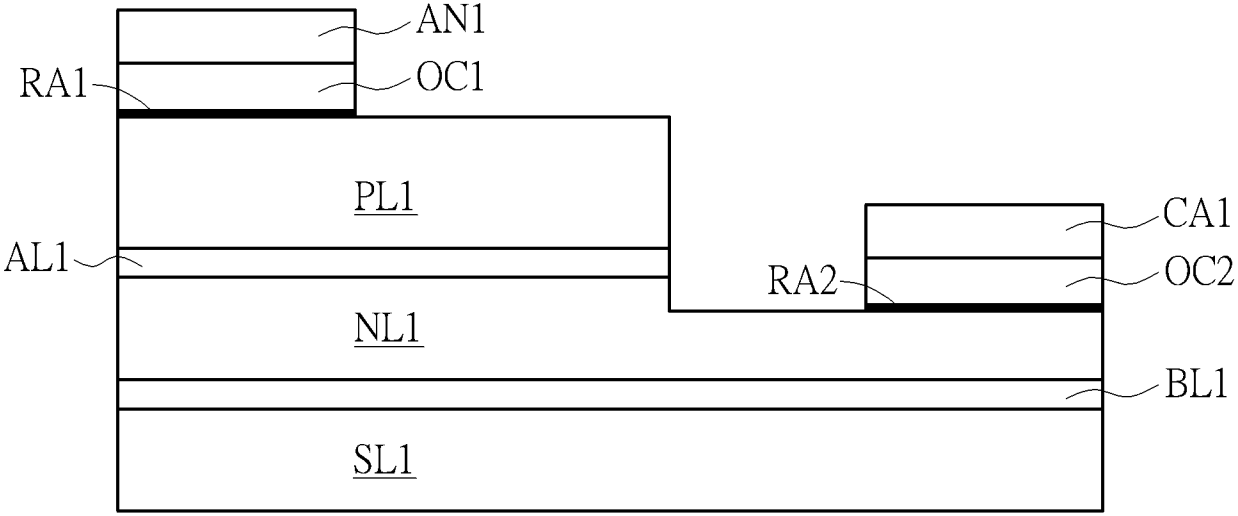
FIG. 6 shows the structure of an LED according to one embodiment.

Furthermore, in some embodiments, the anode of at least one of illumination portions 110A, 110B, 110C, 110D, and 110E may be coupled to the P-type doped layer through the region of the first ohmic contact. FIG. 6 shows the structure of an illumination portion according to one embodiment. In FIG. 6, the illumination portion can include a P-type doped layer PL1, an active layer AL1, an N-type doped layer NL1, a buffer layer BL1, and a sapphire layer SL1. In this case, the anode AN1 of the illumination portion can be coupled to the P-type doped layer PL1 through the region RA1 of the first ohmic contact OC1, and the cathode CA1 of the LED can be coupled to the N-type doped layer NL1 through the region RA2 of the second ohmic contact OC2. The ohmic contacts OC1 and OC2 can be formed by Indium Tin Oxide (ITO) or other suitable materials, and is adopted as an intermediate conductor between two different materials, that is, the metal material of the anode AN1 and the cathode CA1 and the semiconductor material of the P-type doped layer PL1 and the N-type doped layer NL1.

In this case, the area of the region RA1 of the first ohmic contact OC1 contacting with the P-type doped layer PL1 will affect the actual current density received by the illumination portion. Therefore, the areas of regions RA1 (or RA2) of the ohmic contacts OC1 (or 0C2) contacting to the P-type doped layer PL1 (or the N-type doped layer NL1) of the illumination portions 110A, 110B, 110C, 110D, and 110E can also be different and can correspond to the area ratio of the illumination portions 110A, 110B, 110C, 110D, and 110E so as to adjust the amplitude of the current density. For example, the area of the region RA1 of the ohmic contact OC1 contacting the P-type doped layer in the first illumination portion 210A can be different from the area of the region RA1 of the ohmic contact OC1 contacting the P-type doped layer in the second illumination portion 210B.

Also, the area of the region RA2 of the second ohmic contact OC2 contacting with the N-type doped layer NL1 may also affect the actual current density received by the LED. Therefore, in some other embodiments, the area of the region RA2 of the second ohmic contact OC2 contacting the N-type doped layer NL1 in the first illumination portion 210A may also be different from the area of the region RA2 of the another ohmic contact OC2 contacting the N-type doped layer NL1 in the second illumination portion 210B.

In addition, in some embodiments, since sizes of the illumination portions 110A and 110E may be quite different, the display device 10 may further include a diffuser for diffusing the light emitted from the sub-pixels 100(1,1) to 100(M,N) so as to mitigate the issue of mura caused by the repeated patterns of the illumination portions of the sub-pixels 100(1,1) to 100(M,N).

In FIG. 2, the driving units 120A, 120B, 120C, 120D, and 120E can drive the groups of LEDs 110A, 110B, 110C, 110D, and 110E with currents of different intensities to present different grey levels, however, in some other embodiments, the driving units 120A, 120B, 120C, 120D, and 120E can drive the groups of LEDs 110A, 110B, 110C, 110D, and 110E with different duty ratios to emit light at different grey levels.

Figure 5:
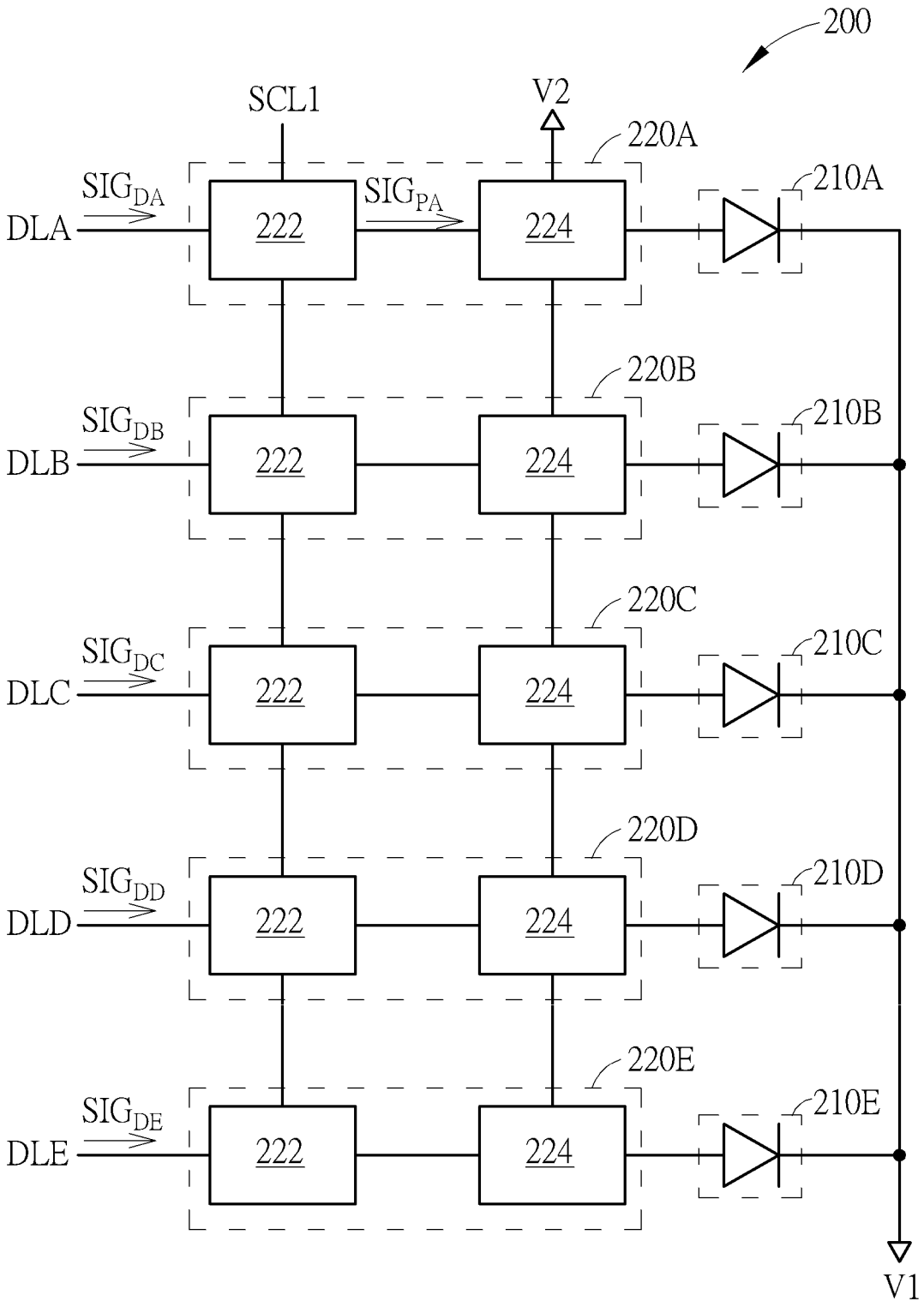
FIG. 5 shows a sub-pixel according to another embodiment of the present disclosure.

FIG. 5 shows a sub-pixel 200 according to one embodiment of the present disclosure. In some embodiments, the sub-pixel 200 can be used in the display device 10 to replace each of the sub-pixels 100(1,1) to 100(M,N). In FIG. 5, each of the driving units 220A, 220B, 220C, 220D, 220E can drive the corresponding illumination portion 210A, 210B, 210C, 210D and 210E to emit light at the different grey levels with a constant current by adjusting the duty ratio of the constant current according to a data signal.

The driving units 220A, 220B, 220C, 220D, and 220E can have the same structure. For example, the driving unit 220A can include a pulse width modulation circuit 222 and a driving circuit 224. The pulse width modulation circuit 222 can receive the data signal $SIG_{DA}$ and generate a pulse signal $SIG_{PA}$ with a duty ratio determined by the data signal $SIG_{DA}$. The driving circuit 224 is coupled to the pulse width modulation circuit 222 and the LED of the corresponding illumination portion. The driving circuit 224 can generate a constant current with the duty ratio according to the pulse signal $SIG_{PA}$.

Figure 7:
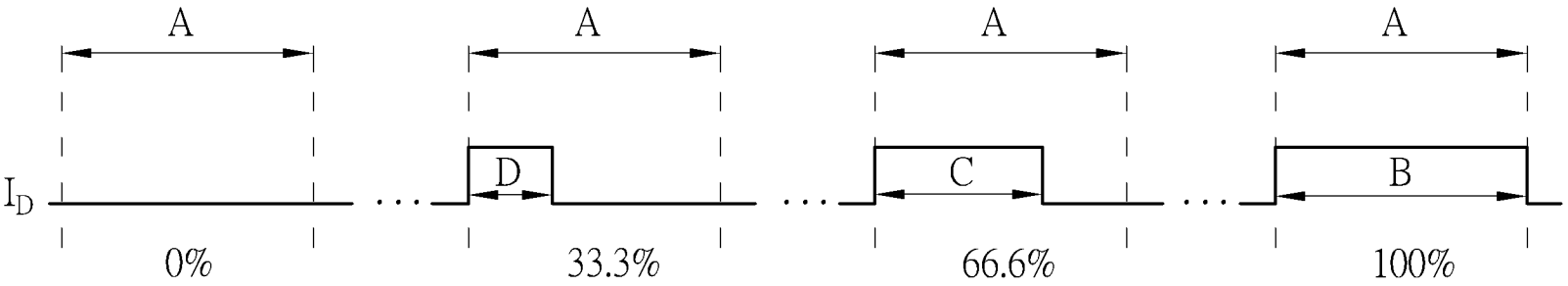
FIG. 7 shows the duty ratios of the current for expressing different grey levels according to one embodiment of the present disclosure.

FIG. 7 shows the duty ratios of the current $I_D$ for expressing different grey levels according to one embodiment. In FIG. 7, the duty ratios can be calculated by B/A, C/A, D/A, while A represents the time length of a frame, and B, C, and D represent the time lengths that the LED is driven.

In FIG. 7, when the data signal $SIG_{DA}$ is corresponding to the brightest grey level, the pulse width modulation circuit 222 may generate the pulse signal $SIG_{PA}$ with a 100% duty ratio. When the data signal $SIG_{DA}$ is corresponding to the second brightest grey level, the pulse width modulation circuit 222 may generate the pulse signal $SIG_{PA}$ with a 66.7% duty ratio. When the data signal $SIG_{DA}$ is corresponding to the third brightest grey level, the pulse width modulation circuit 222 may generate the pulse signal $SIG_{PA}$ with a 33.3% duty ratio. Also, when the data signal $SIG_{DA}$ is corresponding to the least grey level, the pulse width modulation circuit 222 may generate the pulse signal $SIG_{PA}$ with a 0% duty ratio.

In this case, the driving unit 220A can control the illumination portion 210A to express four different grey levels by adjusting the duty ratio of the constant current $I_D$. Therefore, the amplitude of the current $I_D$ can be predetermined properly, preventing the color shift issue caused by small currents.

Also, in FIG. 5, the driving units 220A, 220B, 220C, 220D, and 220E can be coupled to different data lines DLA, DLB, DLC, DLD, and DLE, and the data signals $SIG_{DA}$ to $SIG_{DE}$ can be serial digital signals for reducing the number of input ports of the driving units 220A, 220B, 220C, 220D, 220E and simplifying the routing.

In FIG. 3 and FIG. 5, the sub-pixels 200 and 300 both include five illumination portions, however, in some other embodiments, the sub-pixel may include more or less illumination portions according to the system requirement.

Figure 8:
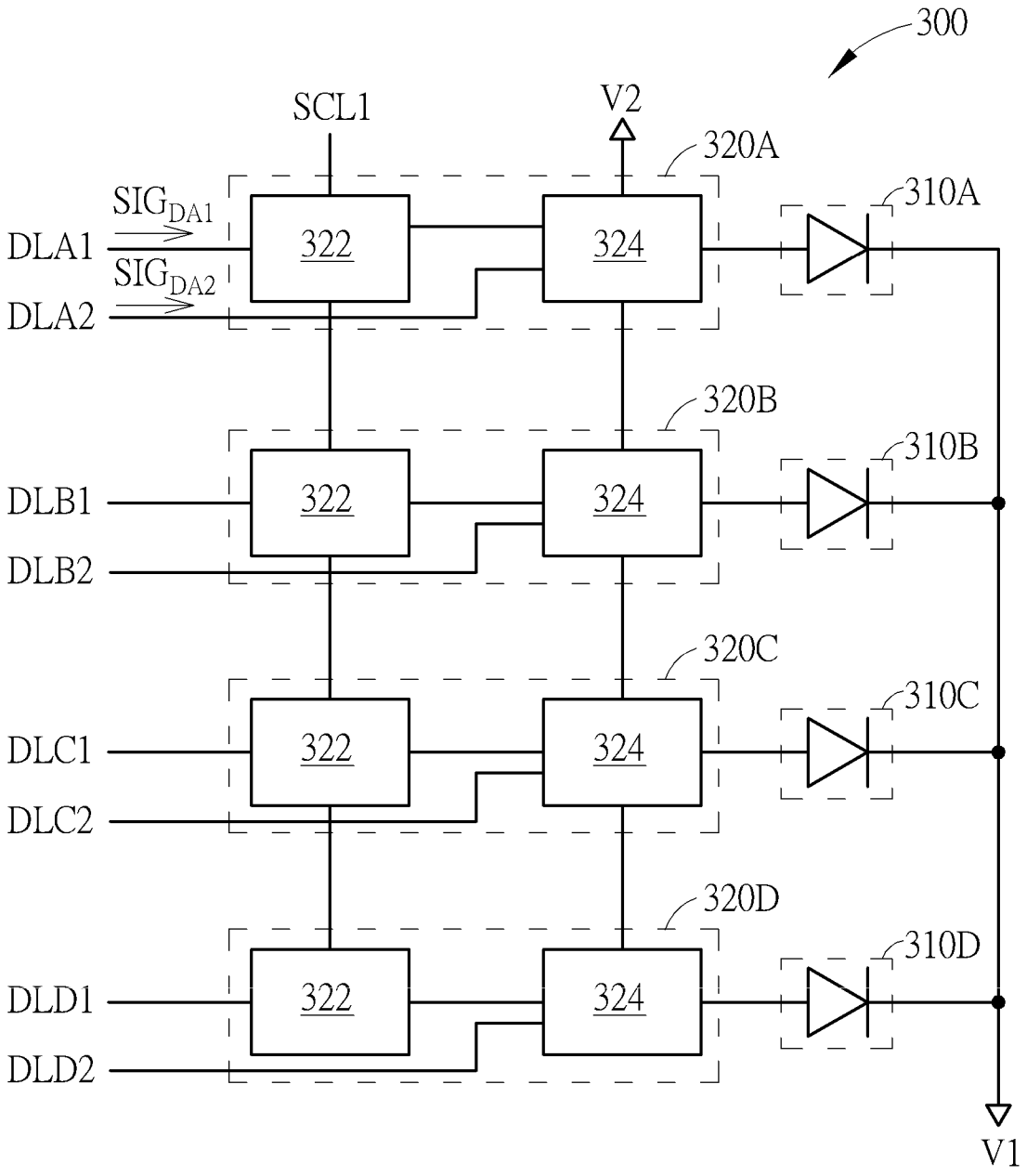
FIG. 8 shows a sub-pixel according to another embodiment of the present disclosure.

FIG. 8 shows a sub-pixel 300 according to one embodiment of the present disclosure. In some embodiments, the sub-pixel 300 can be used in the display device 10 to replace each of the sub-pixels 100(1,1) to 100(M,N). In FIG. 8, each of the driving units 320A, 320B, 320C, and 320D can drive the corresponding illumination portions 310A, 310B, 310C, and 310D to emit light at the different grey levels by adjusting both the amplitude of the current and the duty ratio of the current.

In FIG. 8, each of the driving units 320A, 320B, 320C, and 320D can be coupled to two data lines for receiving two data signal. For example, the driving units 320A can be coupled to the data lines DLA1 and DLA2, the driving units 320B can be coupled to the data lines DLB1 and DLB2, the driving units 320C can be coupled to the data lines DLC1 and DLC2, and the driving units 320D can be coupled to the data lines DLD1 and DLD2.

The driving units 320A, 320B, 320C, and 320D can have the same structure. For example, the driving unit 320A can include a pulse width modulation circuit 322 and a driving circuit 324. The pulse width modulation 322 can receive a first data signal $SIG_{DA1}$ and generate a pulse signal $SIG_{PA}$ with a duty ratio determined by the first data signal $SIG_{DA1}$. Also, the driving circuit 324 can be coupled to the pulse width modulation circuit 322 and the LED of the corresponding illumination portion 310A. The driving circuit 324 can generate the current $I_D$ according to a second data signal $SIG_{DA2}$, and output the current with the duty ratio determined by the pulse signal $SIG_{PA}$. That is, the driving units 320A, 320B, 320C, and 320D can drive the illumination portions 310A, 310B, 310C, and 310D to express different grey levels by adjusting both the duty ratio and the amplitude of the current.

Furthermore, in some embodiments, the area ratio of the illumination portions 310A, 310B, 310C and 310D can be 1:8:64:512. Also, each of the driving units 320A, 320B, 320C, and 320D can drive the corresponding illumination portion to express eight grey levels. For example, the driving unit 320A coupled to the illumination portion 310A can drive the illumination portion 310A to express eight grey levels, and the driving unit 320B coupled to the illumination portion 310B can drive the illumination portion 310B to express eight grey levels. In this case, the illumination portions 310A and 310B will be able to present 64 grey levels, and the illumination portions 310A, 310B, 310C, and 310D will be able to present 4096 grey levels in total.

Table 1 shows the amplitude and the duty ratio of the current generated by the driving unit 320A for presenting the eight grey levels.

| Grey level | Amplitude ratio of the current | Duty ratio of the current | Brightness ratio |
|---|---|---|---|
| 1 | 1 | 100% | 1 |
| 2 | 6/7 | 100% | 6/7 |
| 3 | 5/7 | 100% | 5/7 |
| 4 | 4/7 | 100% | 4/7 |
| 5 | 6/7 | 50% | 3/7 |
| 6 | 4/7 | 50% | 2/7 |
| 7 | 5/7 | 20% | 1/7 |
| 8 | 1 | 0% | 0 |

That is, to present the brightest grey level, the driving unit 320A can drive the illumination portion 310A by providing the current with the first amplitude (1) and a 100% duty ratio. Also, the driving unit 320A can drive the illumination portion 310A to express a second grey level by providing the current with the second amplitude (6/7) and a 100% duty ratio, the driving unit 320A can drive the illumination portion 310A to express a third grey level by providing the current with the third amplitude (5/7) and a 100% duty ratio, and the driving unit 320A can drive the illumination portion 310A to express a fourth grey level by providing the current with the fourth amplitude (4/7) and a 100% duty ratio. Also, the driving unit 320A can drive the illumination portion 310A to express a fifth grey level by generating the current with the second amplitude (6/7) and a 50% duty ratio, the driving unit 320A can drive the illumination portion 310A to express a sixth grey level by providing the current with the fourth amplitude (4/7) and a 50% duty ratio, and the driving unit 320A can drive the illumination portion 310A to express a seventh grey level by providing the current with the third amplitude (5/7) and a 20% duty ratio.

In this case, by adjusting the duty ratio, the driving unit 320A can drive the illumination portion 310A to present eight grey levels with currents having amplitude of 4 different levels without using low current, thereby preventing the color shift issue caused by small currents.

Furthermore, in table 1, to present the least grey level, the driving unit 320A can control the illumination portion 310A by providing the current with the first amplitude (1) and a 0% duty ratio. However, in some other embodiments, the driving unit 320 may also simply not drive the illumination portion 310A by not providing the current.

In some embodiments, the driving units 320B, 320C, and 320D can use similar approaches to drive the illumination portions 310B, 310C, and 310D. In this case, the 8 different grey levels presented by each illumination portion 310A, 310B, 310C, and 310D can be generated by 3 bits, then the grey level presented by the illumination portions 310A, 310B, 310C, and 310D can be determined by 12 bits. In this case, the illumination portion 310A can be controlled by the 3 least significant bits of the 12 bits, and the illumination portion 310D can be controlled by the 3 most significant bits of the 12 bits. Therefore, the sub-pixel 300 would be able to present $2^{12}$ (4096) grey levels in total.

Figure 9:
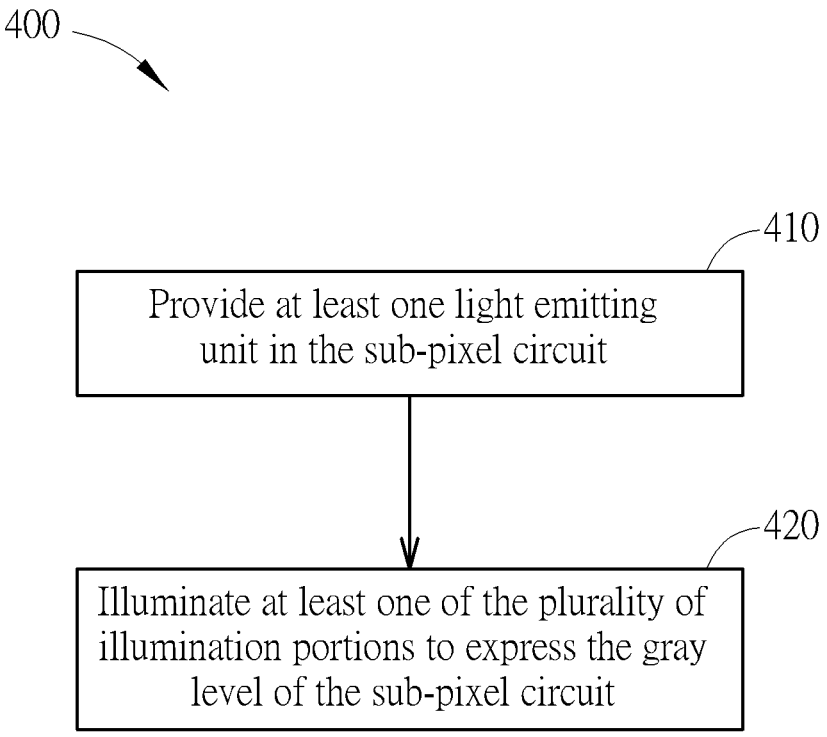
FIG. 9 shows a method 400 for operating a sub-pixel in a display device according to one embodiment.

FIG. 9 shows a method 400 for operating a sub-pixel in a display device according to one embodiment. The method 400 includes steps S410 and S420.

S410: providing at least one light emitting unit in the sub-pixel; and

S420: illuminating at least one of the plurality of illumination portions to express the grey level of the sub-pixel.

In some embodiments, the light emitting unit 110 can be provided in the sub-pixel 100(1,1) in step S410, and the illumination portions 110A, 110B, 110C, 110D and 110E can be illuminated in step S420. In some embodiments, step S420 can be performed adjusting the amplitudes of the currents provided to the illumination portions 110A, 110B, 110C, 110D and 110E. For example, the illumination portion 110A can be driven to express different grey levels with currents of different amplitude as shown in FIG. 4.

Furthermore, the illumination portions 110A, 110B, 110C, 110D and 110E can be illuminated independently. For example, the current provided to the illumination portion 110A and the current provided to the illumination portion 110B may have different amplitude. In some other embodiments, if the method 400 is used to operate the sub-pixel 200 in FIG. 5, then step S420 can be performed by adjusting the duty ratios of the currents provided to the illumination portions 210A, 210B, 210C, 210D, and 210E. For example, the illumination portion 210A can be driven to express different grey levels with currents of different duty ratios as shown in FIG. 5.

Also, the illumination portions 210A, 210B, 210C, 210D and 210E can be illuminated independently. For example, the current provided to the illumination portion 210A and the current provided to the illumination portion 210B may have different duty ratios.

In some other embodiments, if the method 400 is used to operate the sub-pixel 300 in FIG. 8, then step S420 can be performed by adjusting the amplitudes and the duty ratios of the currents provided to the illumination portions 310A, 310B, 310C, and 310D. For example, the illumination portion 310A can be driven to express different grey levels with currents of different amplitudes and different duty ratios as shown in table 1.

Also, the illumination portions 310A, 310B, 310C, and 310D can be illuminated independently. For example, the current provided to the illumination portion 310A and the current provided to the illumination portion 310B may have different amplitudes and different duty ratios.

In summary, the sub-pixels and the methods for expressing a grey level of a sub-pixel in a display device provided by the embodiments of the present disclosure can present different grey levels by controlling the brightness presented by a plurality of illumination portions. Therefore, the sub-pixels and the display device are able to present much more grey levels in different frames with a flexible design compared with prior art. Furthermore, by controlling the grey level of each illumination portion with the current having proper amplitude and a proper duty ratio, the color shift issue caused by small currents can be prevented.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A method for expressing a grey level of a sub-pixel in a display device, comprising:

providing at least one light emitting unit in the sub-pixel, the light emitting unit comprising a plurality of illumination portions, each illumination portion being configured to be illuminated independently; and illuminating at least one of the plurality of illumination portions to express the grey level of the sub-pixel;

wherein:

the plurality of illumination portions comprise a first illumination portion and a second illumination portion;

an area of the second illumination portion is eight times an area of the first illumination portion;

the first illumination portion expresses one of first eight grey levels according to a first current;

the second illumination portion expresses one of second eight grey levels according to a second current; and the first illumination portion and the second illumination portion express one of 64 grey levels according to the first current and the second current;

when the first current has a first amplitude and a 100% duty ratio, the first illumination portion expresses a first grey level of the first eight grey levels;

when the first current has a second amplitude and a 100% duty ratio, the first illumination portion expresses a second grey level of the first eight grey levels;

when the first current has a third amplitude and a 100% duty ratio, the first illumination portion expresses a third grey level of the first eight grey levels;

when the first current has a fourth amplitude and a 100% duty ratio, the first illumination portion expresses a fourth grey level of the first eight grey levels;

when the first current has the second amplitude and a 50% duty ratio, the first illumination portion expresses a fifth grey level of the first eight grey levels;

when the first current has the fourth amplitude and a 50% duty ratio, the first illumination portion expresses a sixth grey level of the first eight grey levels;

when the first current has the third amplitude and a 20% duty ratio, the first illumination portion expresses a seventh grey level of the first eight grey levels;

a ratio of the first amplitude, the second amplitude, the third amplitude, and the fourth amplitude is 7:6:5:4.

2. The method of claim 1, wherein illuminating the at least one of the illumination portions comprises:

providing the first current to the first illumination portion of the plurality of illumination portions; and providing the second current to the second illumination portion of the plurality of illumination portions;

wherein an amplitude of the first current is different from an amplitude of the second current.

3. The method of claim 1, wherein illuminating the at least one of the illumination portions comprises:

providing the first current with a first duty ratio to the first illumination portion of the plurality of illumination portions; and providing the second current with a second duty ratio to the second illumination portion of the plurality of illumination portions;

wherein the first duty ratio is different from the second duty ratio.

4. The method of claim 1, wherein illuminating the at least one of the illumination portions comprises:

providing the first current with a first duty ratio to the first illumination portion of the plurality of illumination portions; and providing the second current with a second duty ratio to the second illumination portion of the plurality of illumination portions;

wherein an amplitude of the first current is different from an amplitude of the second current, and the first duty ratio is different from the second duty ratio.

5. The method of claim 1, wherein:

when the first current has the first amplitude and a 0% duty ratio, the first illumination portion expresses an eighth grey level of the first eight grey levels.

6. A display device comprising a plurality of sub-pixels, one of the plurality of sub-pixels comprising:

at least one light emitting unit comprising a plurality of illumination portions; and a plurality of driving units, each coupled to a corresponding illumination portion of the plurality of illumination portions, and configured to drive the corresponding illumination portion to express a plurality of grey levels in different frames;

wherein:

the plurality of illumination portions comprise a first illumination portion and a second illumination portion;

the plurality of driving units comprise a first driving unit;

an area of the second illumination portion is eight times an area of the first illumination portion;

the first illumination portion is configured to express one of first eight grey levels according to a first current;

the second illumination portion is configured to express one of second eight grey levels according to a second current; and the first illumination portion and the second illumination portion express one of 64 grey levels;

the first driving unit drives the first illumination region to express a first grey level of the first eight grey levels by providing the first current with a first amplitude and a 100% duty ratio;

the first driving unit drives the first illumination region to express a second grey level of the first eight grey levels by providing the first current with a second amplitude and a 100% duty ratio;

the first driving unit drives the first illumination region to express a third grey level of the first eight grey levels by providing the first current with a third amplitude and a 100% duty ratio;

the first driving unit drives the first illumination region to express a fourth grey level of the first eight grey levels by providing the first current with a fourth amplitude and a 100% duty ratio;

the first driving unit drives the first illumination region to express a fifth grey level of the first eight grey levels by providing the first current with the second amplitude and a 50% duty ratio;

the first driving unit drives the first illumination region to express a sixth grey level of the first eight grey levels by providing the first current with the fourth amplitude and a 50% duty ratio;

the first driving unit drives the first illumination region to express a seventh grey level of the first eight grey levels by providing the first current with the third amplitude and a 20% duty ratio; and a ratio of the first amplitude, the second amplitude, the third amplitude, and the fourth amplitude is 7:6:5:4.

7. The display device of claim 6, wherein each of the plurality of driving units is configured to drive the corresponding illumination portion to express the plurality of grey levels by adjusting amplitude of a current and a duty ratio of the current according to at least one data signal.

8. The display device of claim 7, wherein each of the plurality of driving units comprises:

a pulse width modulation circuit configured to receive a first data signal of the at least one data signal and generate a pulse signal with a duty ratio determined by the first data signal; and a driving circuit coupled to the pulse width modulation circuit and a light emitting diode of the corresponding illumination portion, and configured to provide the current according to a second data signal of the at least one data signal, and output the current with the duty ratio.

9. The display device of claim 7, wherein the at least one data signal is a serial digital signal.

10. The display device of claim 6, wherein:

the first driving unit controls the first illumination region to express an eighth grey level of the first eight grey levels by providing the first current with the first amplitude and a 0% duty ratio.

11. The display device of claim 6, wherein:

the first illumination portion of the plurality of illumination portions includes a first ohmic contact coupled between an electrode and a doped layer of the first illumination portion;

the second illumination portion of the plurality of illumination portions includes a second ohmic contact coupled between an electrode and a doped layer of the second illumination portion; and an area of a region of the first ohmic contact contacting the doped layer of the first illumination portion is different from an area of a region of the second ohmic contact contacting the doped layer of the second illumination portion.

* * * * *